US005115611A

United States Patent [19]

Lim et al.

[11] Patent Number: 5,115,611

[45] Date of Patent: May 26, 1992

[54] METAL CLADDING SYSTEMS

[75] Inventors: Guy H. Lim, Rotterdam; Willem Rijnders, Papendrecht; Cornelis Louwerens, Rotterdam, all of Netherlands

[73] Assignee: Hunter Douglas International, Curacao, Netherlands Antilles

[21] Appl. No.: 570,262

[22] Filed: Aug. 20, 1990

[30] Foreign Application Priority Data

Aug. 25, 1989 [GB] United Kingdom ..... 8919330
Jun. 22, 1990 [GB] United Kingdom ..... 9014274

[51] Int. Cl.[5] ..... E04B 2/00

[52] U.S. Cl. ..... 52/537; 52/762; 52/763; 52/484; 52/222

[58] Field of Search ..... 52/762, 763, 764, 484, 52/488, 222, 537

[56] References Cited

U.S. PATENT DOCUMENTS 3,277,622 10/1966 Jensen ..... 52/762
3,305,994 2/1967 Amrhein et al. ..... 52/763

FOREIGN PATENT DOCUMENTS 4597168 5/1971 Australia .
1955780 6/1971 Fed. Rep. of Germany .
2353231 5/1975 Fed. Rep. of Germany .
3017103 11/1981 Fed. Rep. of Germany .
2081712 12/1971 France .
69411 5/1974 Luxembourg .
415146 8/1934 United Kingdom .
986887 3/1965 United Kingdom .
1393346 5/1975 United Kingdom .
2164972 4/1986 United Kingdom .

*Primary Examiner*—David A. Scherbel
*Assistant Examiner*—Wynn Wood
*Attorney, Agent, or Firm*—Fleit, Jacobson, Cohn, Price, Holman & Stern

[57] ABSTRACT

The specification discloses a method of forming a self sustained cladding panel 10 for use in a cladding panel system for a building using a resilient material or metal alloy sheet material. The panels have a central visible portion 12 and longitudinally extending side edges 14, 16. The central visible portion has, in its relaxed state, a shape which is significantly different from the intended final shape and the panel is subsequently formed so that its central visible portion is resiliently formed into the final shape, with a resilient deformation taking place within the elastic range of the sheet material. The panel is then retained in this final shape by interconnecting the longitudinally extending side edges 14, 16 either continuously or by spaced elements such as clips.

32 Claims, 8 Drawing Sheets

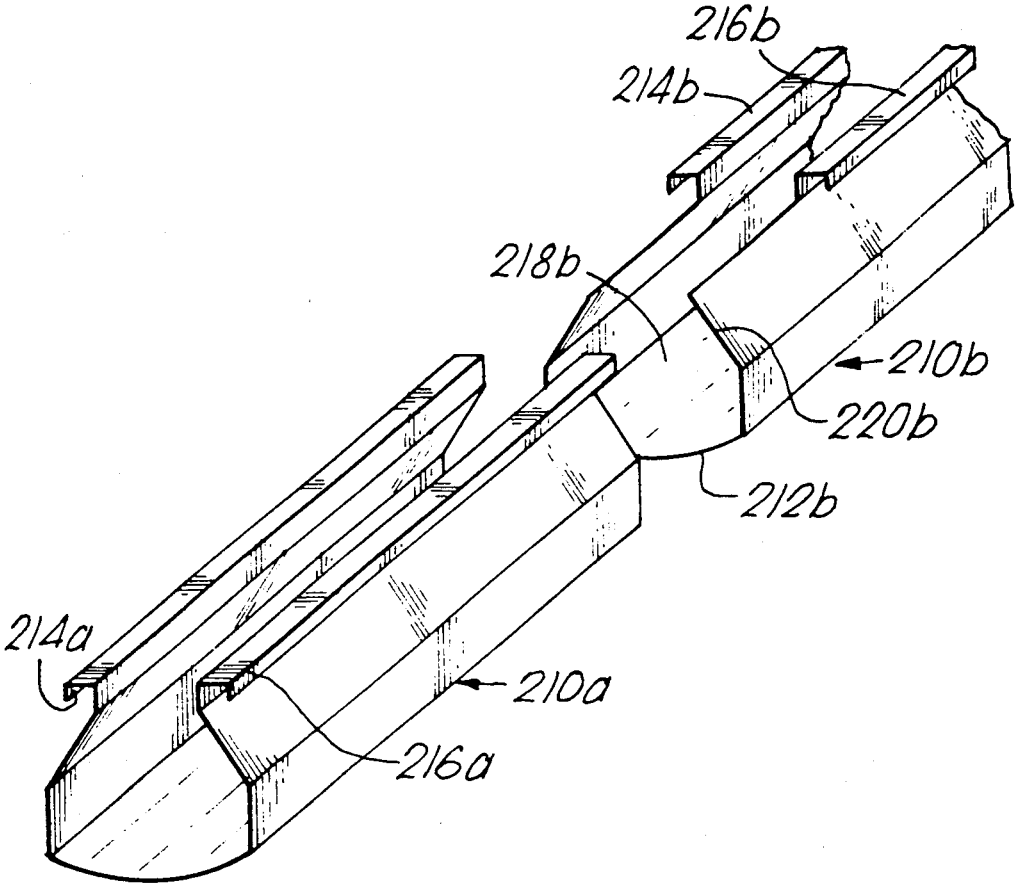
Fig.22.
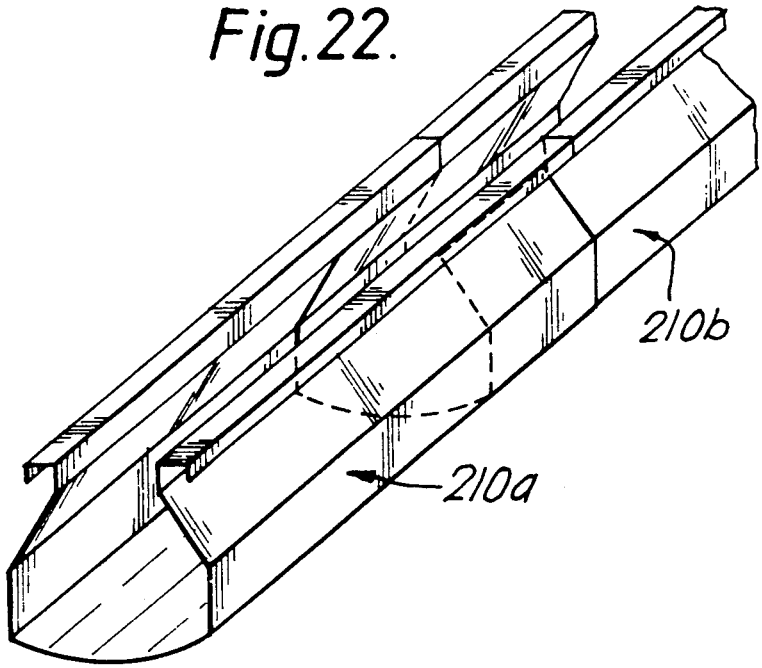

METAL CLADDING SYSTEMS

The present invention relates to a metal cladding system for a building and to methods of its manufacture. The cladding systems may be used for example for covering the walls or ceilings of a building.

Ceilings using elongate panels are usually formed from 0.5 mm thick aluminium strip, for example from an aluminium AL-Mg alloy such as AA 5050 having good formability by roll forming.

The aluminium alloy AL-Mg/Si, such as AA 6011, used for venetian blind slats or other high manganese aluminium alloys such as AA 5182 used in the production of can bodies are of a stiffer grade and are much more resilient. Such hard alloy material is readily available in thicknesses of about 0.2 mm for use in the manufacture of venetian blind slats or can bodies. During the act of its forming, the characteristics and behaviour of these or other hard alloys can be somewhat compared to those of cardboard. If such materials were to be used for ceiling panels, then material costs would be drastically lowered, but the usual form of equipment and techniques involved cannot be used.

According to one aspect of the present invention there is provided a method of forming a self sustained cladding panel for use in a cladding panel system for a building from a resilient metal or metal alloy sheet material, said panels having a central visible portion and longitudinally extending side edges, said method comprising the steps of initially providing said panels so that the central visible portion has, in its relaxed state, a shape which is significantly different from the intended final shape, subsequently forming said panel so that its central visible portion is resiliently deformed into said final shape, with the resilient deformation taking place within the elastic range of the sheet material and retaining said panel in its final shape by interconnecting said longitudinally extending side edges.

Such a method is adapted to make use of this low cost venetian blind slat material alloy in a thin form and overcomes the normal problems of thinner gauge material which has a tendency to form what are known as tension distortions in large area surfaces referred also to as "oil-canning". The method of the present invention also overcomes the problem that the alloy used for venetian blind slats has an inherently greater spring-back requiring a different roll-forming technique, using smaller bend radii and a greater amount of overbending to cope with the greater spring-back and yield strength.

Rather surprisingly, it has been found that a slight curvature of the central visible area within the elastic range of the material deformation is sufficient to suppress the so-called "oil-canning" effect.

The final shape of each panel may be obtained by bending the central visible portion of that panel inwardly or outwardly relative to the panel. Furthermore, the central visible portion of each panel can, if desired, be flat or curved in the relaxed state and prior to interconnecting the longitudinal side edges thereof. If it is curved, the final shape may be obtained by increasing or reducing the radius of curvature of the central portion.

In a somewhat modified arrangement, the curved effect of the central portion of panel, in its relaxed state, may be formed by a plurality of laterally adjacent longitudinally extending facets, each facet being connected to its neighbour by a curved connecting portion permanently formed in said material with a radius of curvature of less than 2 mm.

Advantageous results have been found to be achieved if the central visible portion is resiliently formed into a bow with a radius of curvature greater than 20 mm.

In one particular construction, the longitudinal side edges of each panel may each be permanently formed with a rim portion comprising at least one permanently deformed edge portion connected to the central portion by a connecting portion with a radius of curvature of less than 2 mm.

Many different ways may be used for interconnecting the longitudinal edges. For example, they may be connected using an adhesive or by at least one clip means.

It is also contemplated that substantially flat intermediate portions are formed, one on each side of said central portion, said intermediate portions extending between said central portion and a longitudinal rim, the intermediate portions being joined to the central visible portion by a permanently deformed transfer portion having a radius of curvature of less than 2 mm.

The invention also provides a method of forming a cladding panel for use in a cladding panel system for a building, said method comprising forming from a stiff grade, high yield strength, resilient aluminium alloy sheet of less than 0.3 mm thickness, providing longitudinally extending beads which have a radius of curvature of less than 2 mm and forming a central visible portion of the panel material so as to have a radius of curvature of greater than 20 mm.

The invention also provides a method of providing a cladding panel for use in a cladding panel system for a building from a resilient metal or metal alloy sheet material, said panels having a central visible portion and longitudinally extending side edges, said method comprising the steps of initially forming said central visible portion into a plurality of laterally adjacent facets and providing the thus formed central visible portion so that it has, in its relaxed state, a shape which is significantly different from the intended final shape.

According to a further aspect of the present invention there is provided a method of forming a cladding panel for use in a cladding panel system for a building, said method comprising the steps of forming from a stiff grade high yield strength, resilient aluminium alloy sheet, longitudinally extending beads, which have a radius of curvature sufficiently small to produce a permanent deformation of the sheet material to be formed and forming a central visible portion of the panel material to have a radius of curvature which significantly exceeds the bend radius which would produce permanent deformation of the sheet material to be formed.

Many forms of apparatus may be utilized for manufacturing panels according to the invention but one embodiment of apparatus for roll forming a plurality of spaced or slightly concaved facets in sheet material comprises two oppositely disposed, said apparatus comprising two oppositely disposed forming rolls, at least one of said rolls comprising axially spaced concave and convex portions, concave portions having a radius of curvature in excess of the radius producing permanent deformation of the sheet material to be formed and the convex portion having a eighties of curvature sufficiently small to produce permanent deformation of the sheet material to be formed.

According to another aspect of the present invention there is provided a self-sustained cladding panel for use in a cladding system for a building, said panel being formed of a resilient metal or metal alloy sheet material and having a generally central visible portion, which in its final shape is formed and maintained under tension within the elastic range of deformation of said material and longitudinally extending side edges, and means interconnecting said longitudinally extending side edges, effective to retain said panel in said final shape with at least the central portion in an elastically deformed state.

The resilient metal or metal alloy may have a high yield strength and a thickness of less than 0.3 mm, for example as little as 0.2 mm as is used in the venetian blind slat material.

The longitudinal side edges of the panel may be interconnected directly in abutting or closely adjacent relationship to form a virtually closed sectional shape or may be interconnected indirectly and maintained at a distance from one another. In the latter case, the longitudinal side edge may be interconnected at least over a part of their longitudinal extent by at least one additional strip like element or at spaced intervals along the length by a plurality of retaining clips. The invention also contemplates a cladding panel for a building comprising a stiff grade, high yield strength, resilient, aluminium alloy sheet material of less than 0.3 mm thickness, said panel having a general central visible portion which is bowed, in use, with a radius of curvature greater than 20 mm and longitudinally extending side edges each formed with a bead having a radius of curvature of less than 2 mm.

According to still further aspects of the present invention, there is provided a cladding system for a building comprising a plurality of panels according to the invention and supporting means mountable to hold the panels by engaging the longitudinal edges of the panels. The supporting means may engage each of the panels internally along the longitudinal edges. It is also contemplated that the supporting means comprise spaced support members, and wherein the means interconnecting said longitudinal edges of each panel comprise clips slidably longitudinally of the panels and wherein at least one of said retaining clips is co-operatively positioned adjacent the support members, to lock the panels in position with respect to said support means.

The invention further contemplates a cladding panel for use in a cladding panel system for a building, said cladding panel comprising a stiff grade, high yield strength, resilient a, aluminium alloy sheet, longitudinally extending beads along each side of the panel, which have a radius of curvature sufficiently small to produce a permanent deformation of the sheet material, and a central visible portion of the panel bent to a radius of curvature which significantly exceeds the bend radius which would produce permanent deformation of the sheet material.

According to another aspect of the invention there is provided a cladding panel for use in a cladding system for a building, said cladding panel comprises a stiff grade, high yield strength, resilient, aluminium alloy sheet, said panel having a generally central visible portion which is formed of a plurality of laterally adjacent facets, and which, in use, is bowed so that the junctions of the facets lie along a locus which has a radius of curvature which significantly exceeds the bend radius of the sheet material which would produce permanent deformation of the sheet material and longitudinally extending side edges each formed with a bead having a radius of curvature sufficiently small to produce a permanent deformation of the sheet material.

Intermediate portions, for example substantially flat intermediate portions, may be provided, one on each side of the bowed central visible portion and extending therefrom to the beads on the longitudinal side edges.

The beads may be connected to the intermediate portion by further portions angled with respect to the intermediate portions and extending, in use, substantially parallel to one another.

The invention also contemplates a cladding system utilizing panels according to the invention and supporting means mountable to hold the panels by engaging longitudinal edges of the panels, internally or externally of the longitudinal edges. The supporting means may comprise spaced support members, and wherein the means connecting said longitudinal edges of each panel with respect to one another comprise clips slidable longitudinally of the panels and wherein at least one of said retaining clips is co-operatively positioned adjacent the support members, to lock the panels in position with respect to said support means.

In a preferred structure, the support members comprise elongate profiled carriers, the profiles of the carriers including a carrier body portion and at least one carrier flange portion, a free edge to the or each carrier flange portion, spaced sets of lugs associated with said free edge or edges for engagement with the side edges of the panels and, located adjacent each set of lugs, a first series of apertures in said at least one flange portion, the apertures of the series being spaced by a certain pitch, wherein the clips each include a clip body portion and a clip flange portion, said clip body portion having associated therewith means to retain the panel in its final shape, a second series of apertures formed in said clip flange portions, the apertures being spaced by said certain pitch and pin means engageable through selected ones of the apertures of the clips and the apertures of the carriers, effective to locate the clips relative to the carriers.

With such a structure, when used as a wall or ceiling cladding, adjacent a perpendicular wall, a panel may be longitudinally cut along a portion intermediate its cross-sectional width, its remaining longitudinally side edge being retained by a clip retaining means and one lug of a set and wherein the cut edge is engaged against retaining means mounted on said perpendicular wall surface.

With the assembly of the invention, the panels may include profiled longitudinal edge rims, and at least some of the panels of the system may have end portions of the longitudinal edge rims removed, so that the central visible portions associated with the removed rims can be telescopically engaged within the ends of the longitudinally adjacent panels.

The invention also contemplates the possibility of providing a cladding system comprising a plurality of panels, said panels each having a generally central visible portion which, in use, is formed into a bowed configuration and maintained under tension within the elastic range of deformation of said material and longitudinal side edges, wherein additional short lengths of panel material are engaged over the panels at longitudinally spaced locations to give a patterned visual effect. These additional short lengths of panel material may be formed of a different colour from the remaining panel material to give a special decorative effect.

In order that the present invention may more readily be understood, the following description is given, merely by way of example, reference being made to the accompanying drawings, in which.

Figure 16:
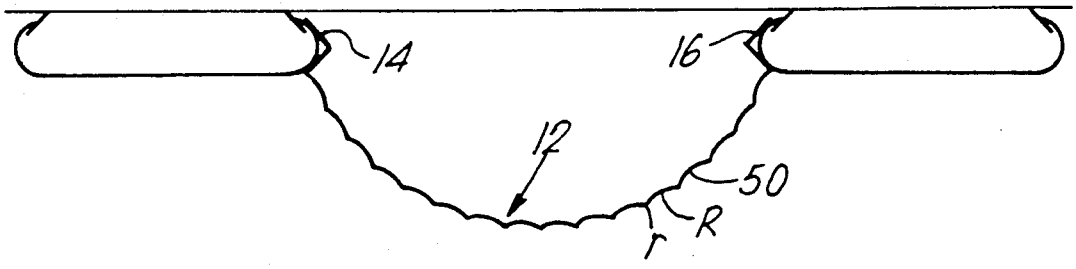
FIG. 16 is a schematic view of a further embodiment of a ceiling panel according to the invention in its installed position.
Figure 17:
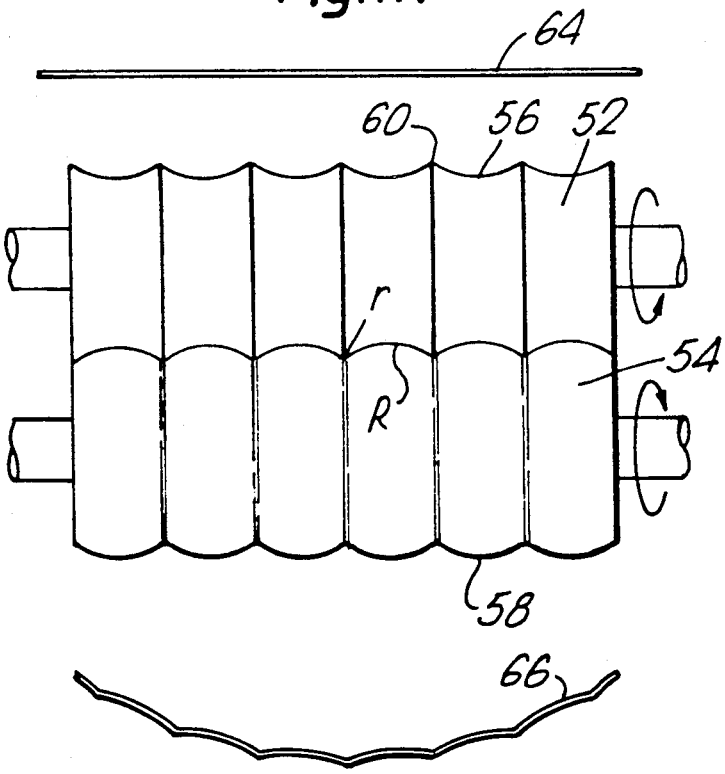
Figure 18:
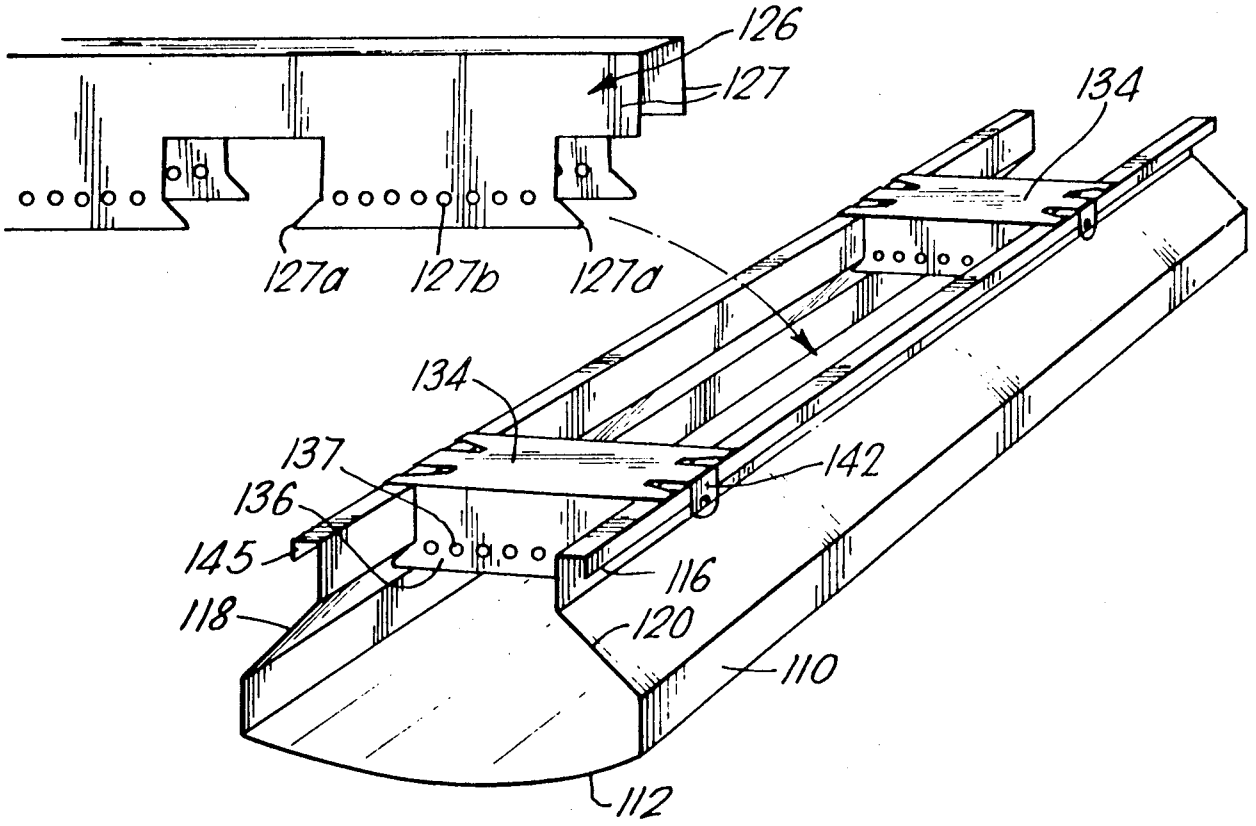
Figure 19:
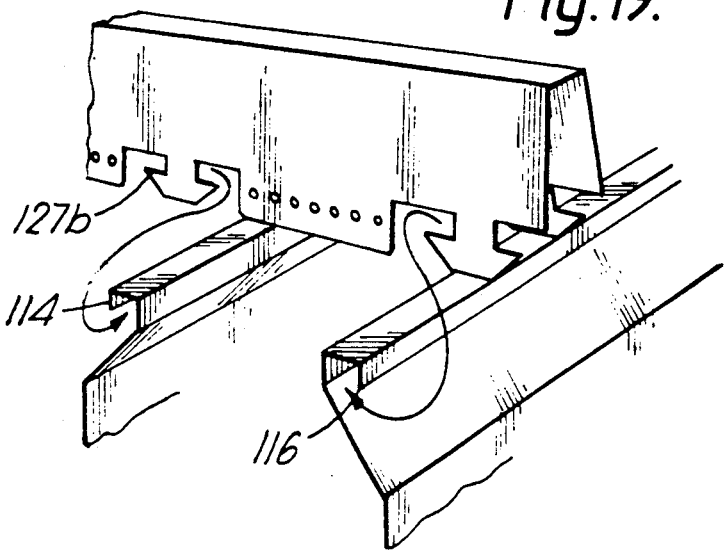
Figure 20:
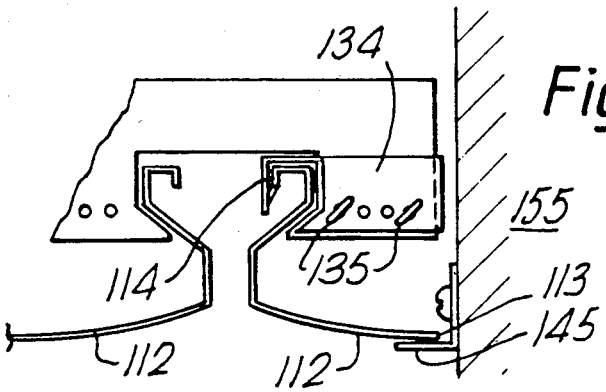
Figure 21:
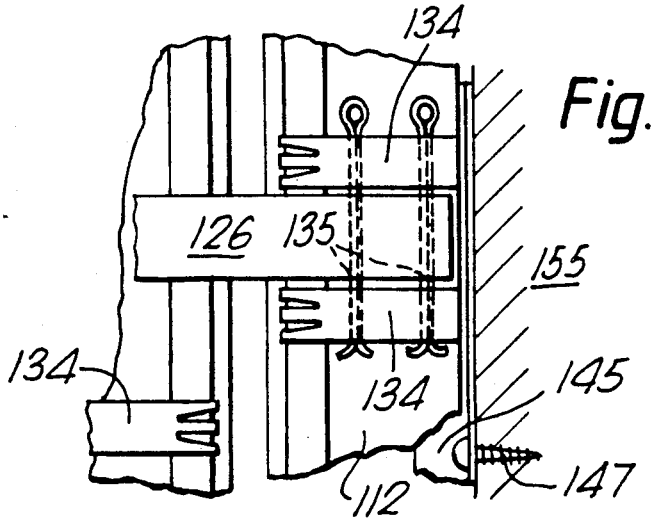
Figure 23:
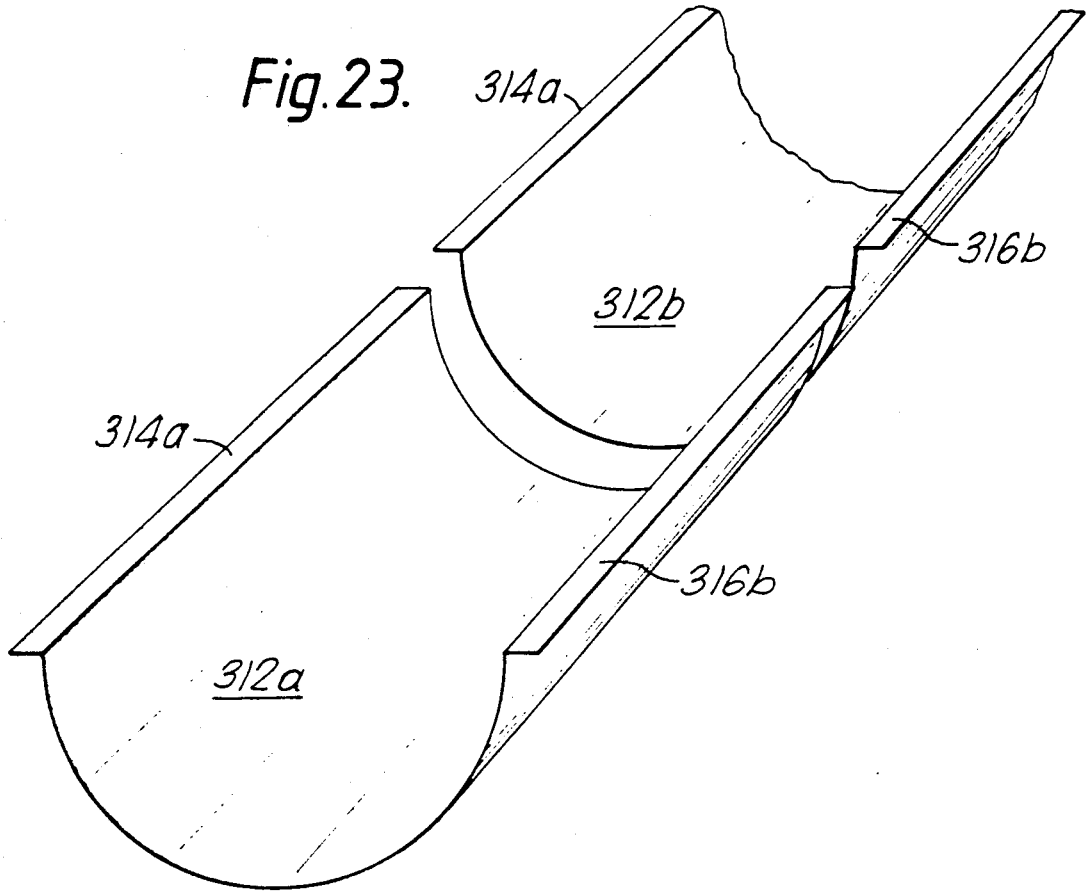
Figure 24:
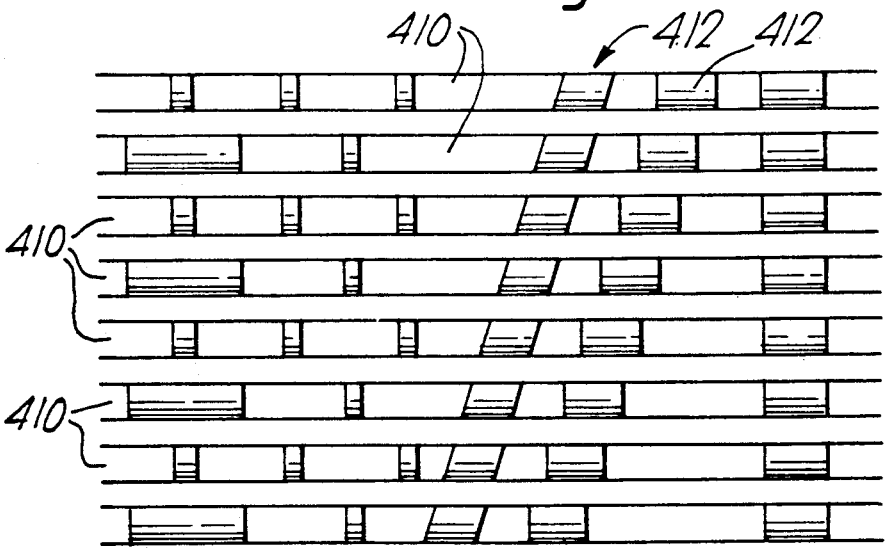

FIG. 17 schematically illustrates forming rolls for forming the facets of the panel embodiment of FIG. 16 as well as illustrating the sheet material before and after formation;

FIG. 18 is an exploded view of a modified form of carrier and clip of a modified assembly according to the invention;

FIG. 19 shows a further modification of the assembly of FIG. 18;

FIG. 20 is an end elevation showing a method of mounting an assembly according to the invention at a location adjacent the wall, inside elevation;

FIG. 21 is a plan view of the fragmentary showing of FIG. 20;

FIG. 22 shows two views of a further modified construction of panel according to the invention with two panel portions being shown separated in the upper figure and interconnected in the lower figure;

FIG. 23 shows a modification of assembling two panel portions end to end;

FIG. 24 shows an underneath plan of a patterned effect which can be achieved using the structure of FIG. 23.

FIGS. **25*a*-29*a* show structures of forming roll which are modifications of those shown in the centre of FIG. 17; and FIG. 25*b*-29*b* show the resulting cross-section of the sheet material after formation with the forming rolls of FIGS. 25*a*-29*a***, respectively.

Figure 1:
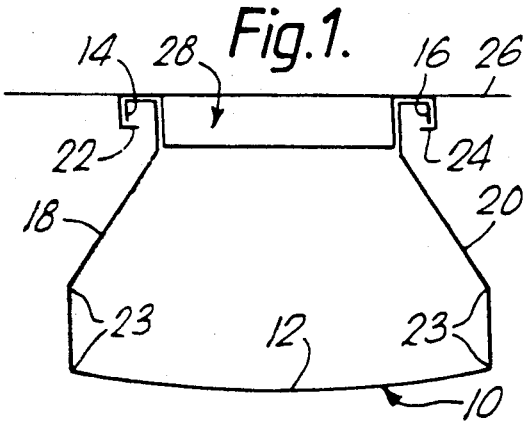
FIGS. 1 and 2 are each schematic cross-sections through two different embodiments of panel according to the invention placed in position to form a ceiling.

Referring first to FIG. 1, there is illustrated a panel indicated by the general reference numeral 10 this having a generally central visible portion 12 and longitudinal edge portions 14, 16, connected to the central visible portion 12 by intermediate portions 18, 20. The edge portions 14, 16 are shown provided as beads engaging in lugs 22, 24 forming part of a clip 28 attached to a carrier 26. Spaced apart central portions of clips 28 are engaged between the intermediate portions 18, 20 after mounting on the lugs 22, 24. If reference is made to FIG. 4, it will be seen that the same panel 10 is shown in full lines in its relaxed position. In this instance the central visible portion 12 is substantially flat and the beads 14, 16 are shown flexed outwardly.

Figure 4:
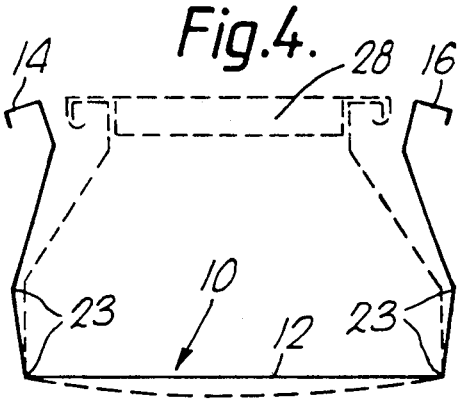
FIG. 4 shows the assembling of the ceiling panels of FIG. 1 or 2.

The material of the panel is a resilient metal or metal alloy sheet material and, as seen in particular in FIG. 4, when the panel is assembled into its final shape, the central visible portion has a final shape which is significantly different from the original shape, this final shape being shown in chain-dotted lines. In its assembled, self-sustained, final state, the central visible portion is resiliently deformed, with the resilient deformation taking place within the elastic range of the sheet material. The lugs 22, 24 retain the panel in its final shape in effect by interconnecting the longitudinally side edges 14, 16. The central portion of clip 28 is used to rigidify the assembly.

Figure 2:
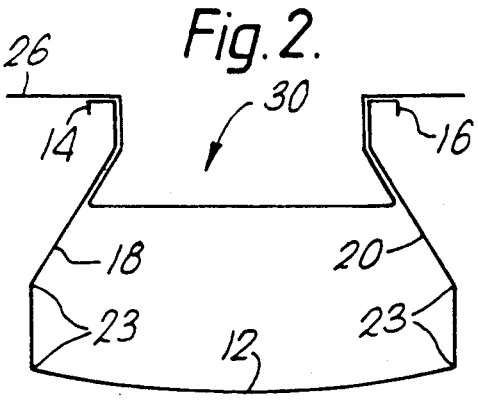

The final structure in FIG. 2 looks similar to that of FIG. 1 and like parts are indicated by the like reference numerals. Instead of having clips 28 attached to the carrier 26, however, a number of prongs 30 are integrally provided which engage within the intermediate portions 18, 20. In this structure, however, the central visible portion may alternatively, in its relaxed state, be more bowed, that is have a smaller radius of curvature than in the final assembled and mounted state shown in FIG. 2. The resilience of the material is then used, at least in part, to retain the intermediate portions 18, 20 against the prong 30. Further retaining clips similar to clip 28 (not shown) may be provided to hold the edge portion 14, 16 in this final position such further retaining clips can also be cooperatively positioned adjacent the prongs 30 to lock the edges of the panels in position against outward deflection with respect to said prongs. In each of the embodiments, however, it will be noted that the central visible portion is bowed. This bowing is advantageously such that the radius of curvature of the central visible portion 12 is greater than 20 mm and, in order further to rigidify the structure, the radius of curvature used in shaping the edge portions is preferably less than 2 mm. The intermediate portions 18, 20 in this embodiment of panel each comprise in fact two substantially flat portions angled with respect to one another and joined to one another and to the central portion 12 and the edge portions 14, 16 through permanently deformed transfer portions 23 connecting having a radius of curvature less than 2 mm.

Figure 3:
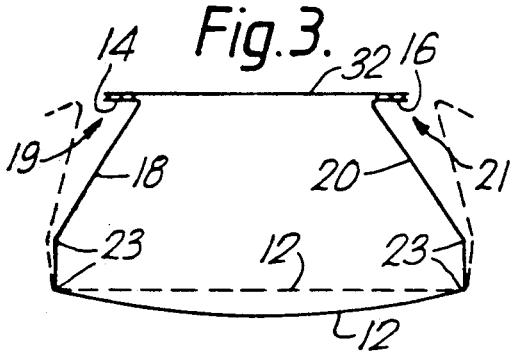
FIG. 3 shows the assembling by interconnection of the longitudinal edges of a further embodiment of panel.

If reference is now made to FIG. 3, it will be seen that the final panel product looks generally similar to those previously described. In this construction the relaxed state of the panel is indicated in chain-dotted lines and the central visible portion is again substantially flat. The intermediate portions 18, 20 are flexed inwardly as indicated by the arrows 19, 21 so that the panel takes up the final shape illustrated in the solid lines, with the central visible portion 12 then curved as before. It will be seen here, however, that the edge portions 14, 16 are secured, for example, by adhesive, to an interconnecting structure 32 which serves to interconnect the edge portion 14, 16 thereby to retain the central visible portion 12 in its bowed configuration as in the previous constructions.

Figure 4A:
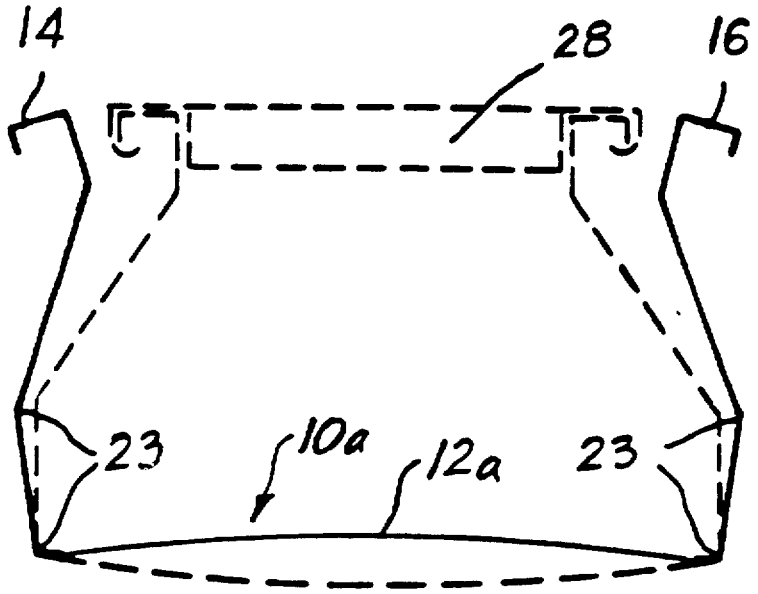
FIG. 4A shows the assembling by interconnection of the longitudinal edges of another embodiment of panel.
Figure 16:
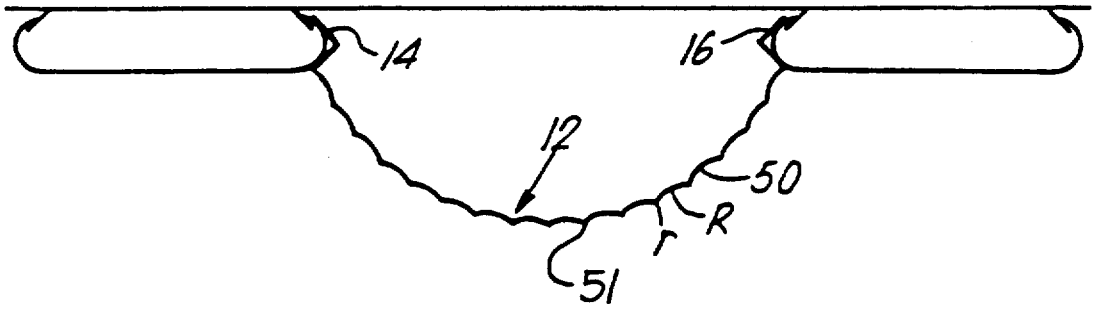
Figure 17:
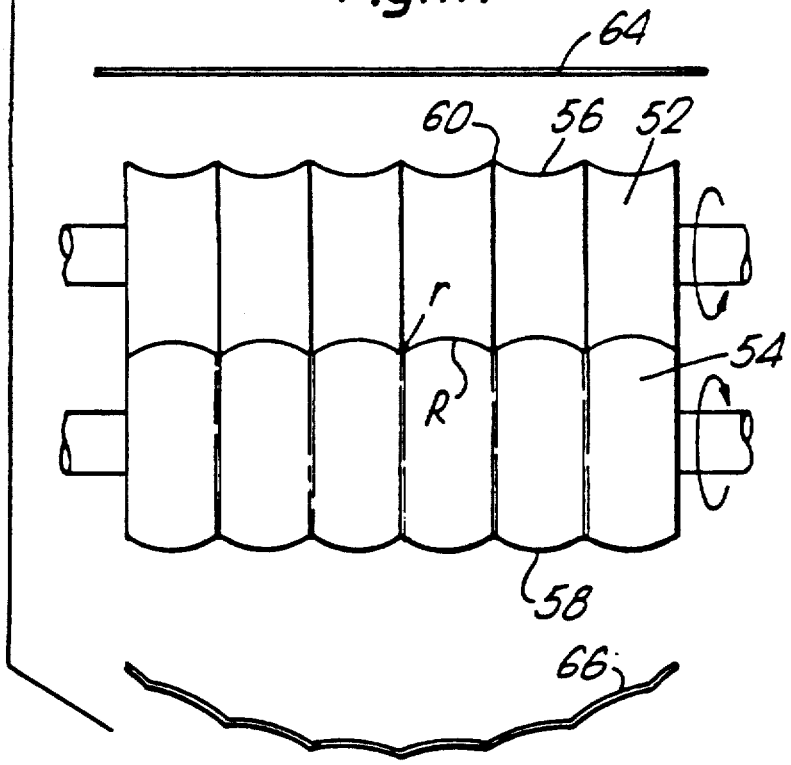
Figure 18:
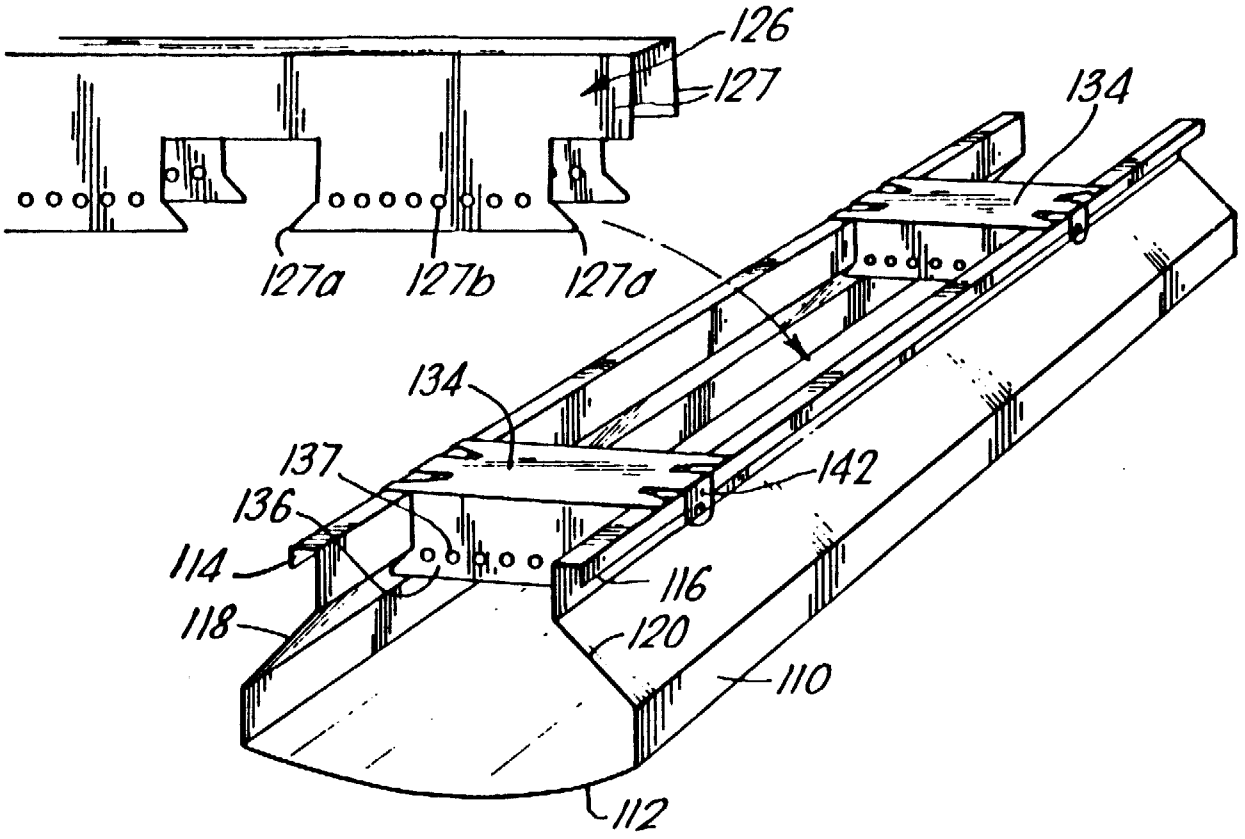
Figure 19:
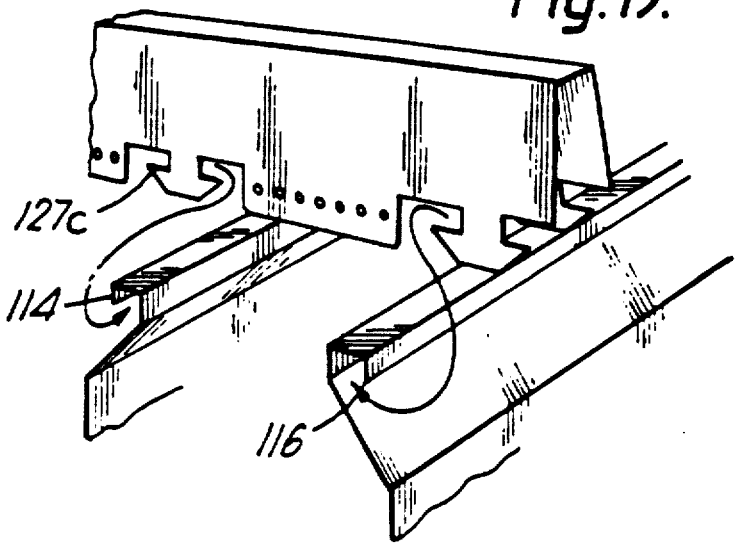
Figure 20:
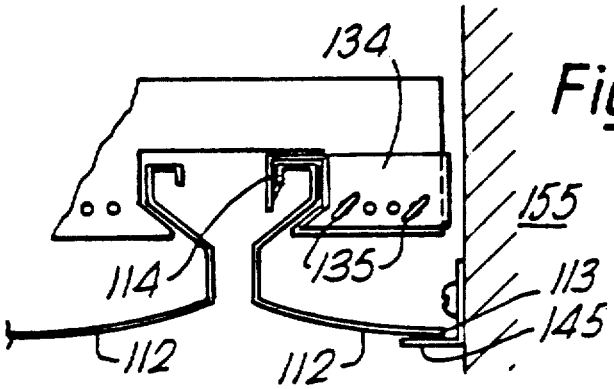
Figure 21:
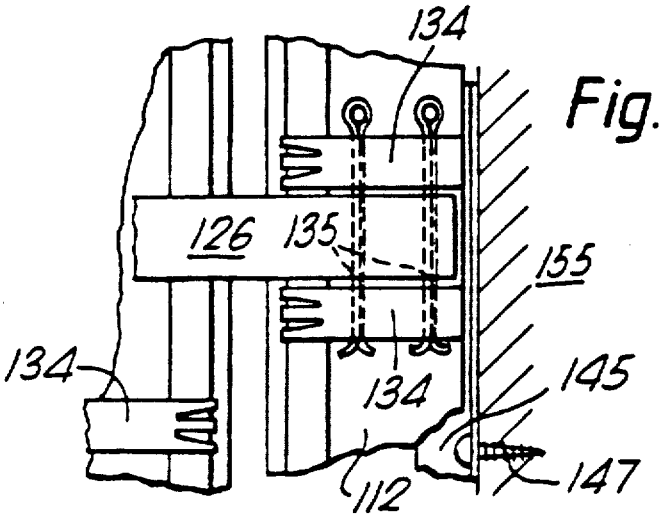
Figure 23:
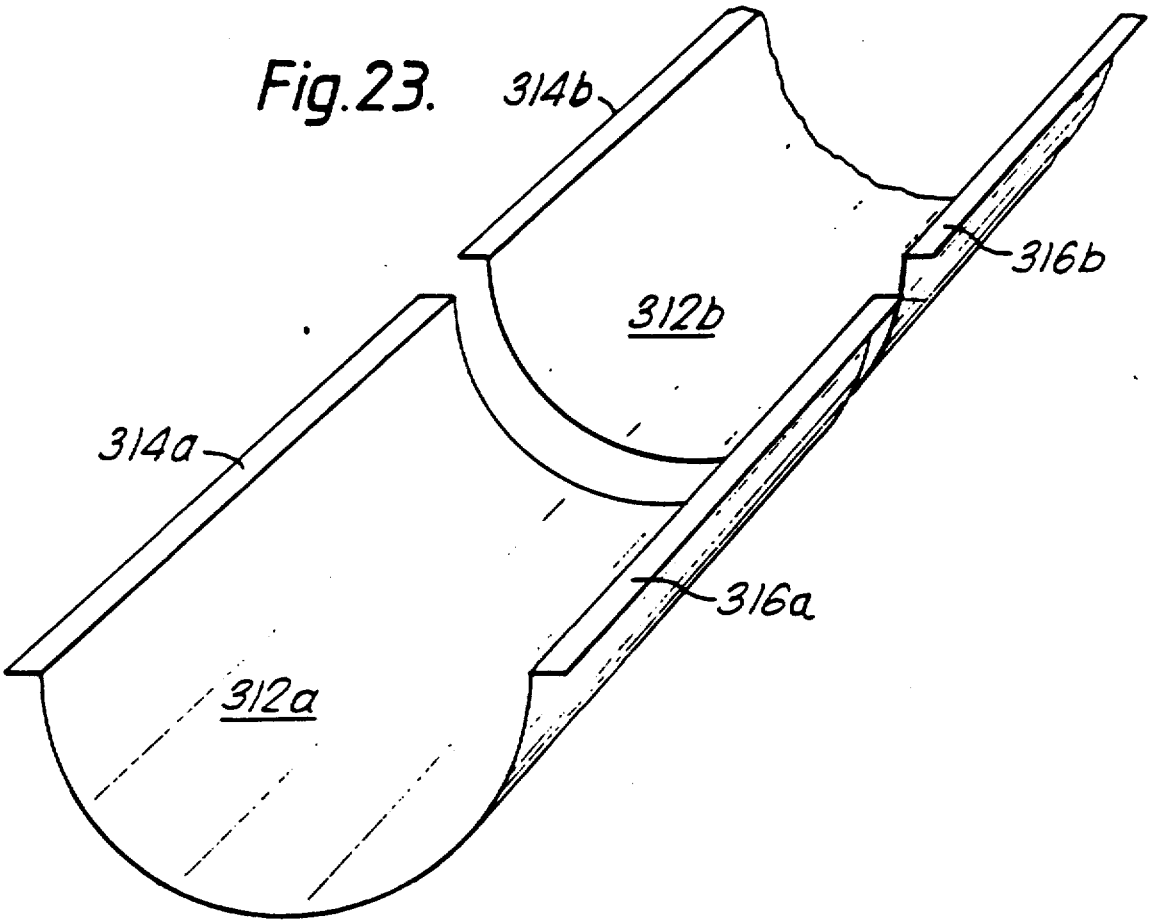
Figure 24:
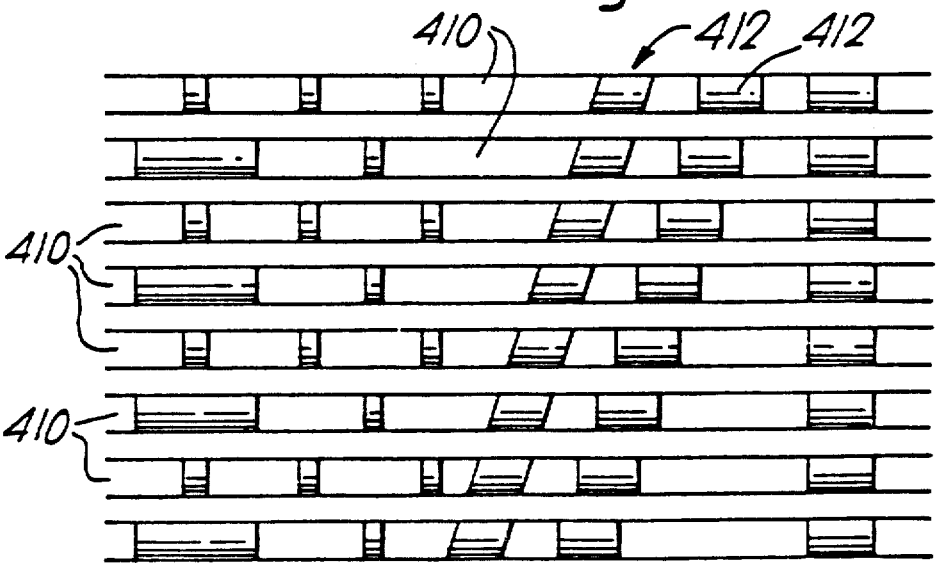

FIG. 4A shows a final panel product **10*a* generally similar to that of FIG. 4, with the exception that, when the panel 10*a* is assembled into its final shape, the central visible portion 12*a* is substantially flat as shown by the chain-dotted lines. In its relaxed state, the central visible portion 12*a*** is negatively bowed as indicated by the solid lines.

Figure 5:
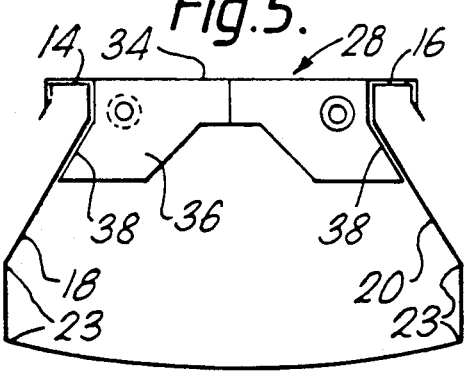
FIGS. 5 and 6 are a side elevation and a plan of one embodiment of securing clips used with the panel of FIG. 4.
Figure 7:
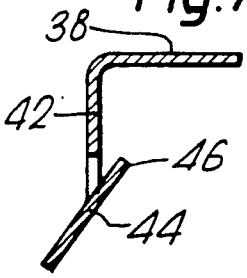
FIG. 7 is an enlarged section taken along the line VII—VII of FIG. 8 of a portion of the clip of FIGS. 5 and 6.
Figure 6:
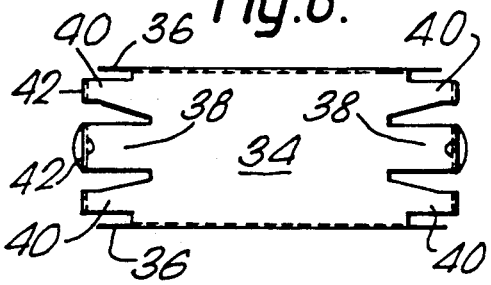
Figure 8:
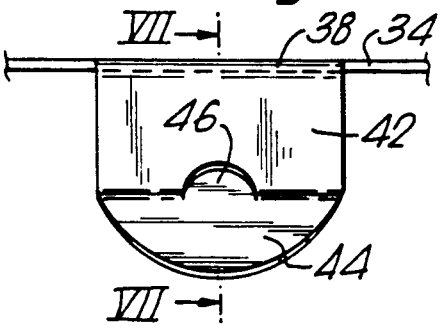
FIG. 8 is an enlarged partial end view of the clip shown in FIG. 7.

One form of clip suitable for use as schematically indicated in the structure of FIGS. 1 and 4, is shown in FIGS. 5-8. Reference is first made to FIG. 5; it will be seen that the clip includes a central body portion 34 and two spaced side flanges 36, only one of which can be seen in FIG. 5 but both of which can be seen in FIG. 6. The flanges 36 have outwardly flared end portions 38 to engage inside the intermediate portions 18, 20 of the panel 10. On each end of the clip body 34 are a central arm 38 and two side arms 40, each central arm 38 being provided with a downwardly projecting end portion 42. FIGS. 7 and 8 illustrate more clearly how this downwardly projection portion 42 of the central arm 38 has a punched out offset portion 44 forming a retaining tab 46. This retaining tab serves to engage the edge portions 14, 16 to hold the panel in its final shape.

Figure 9:
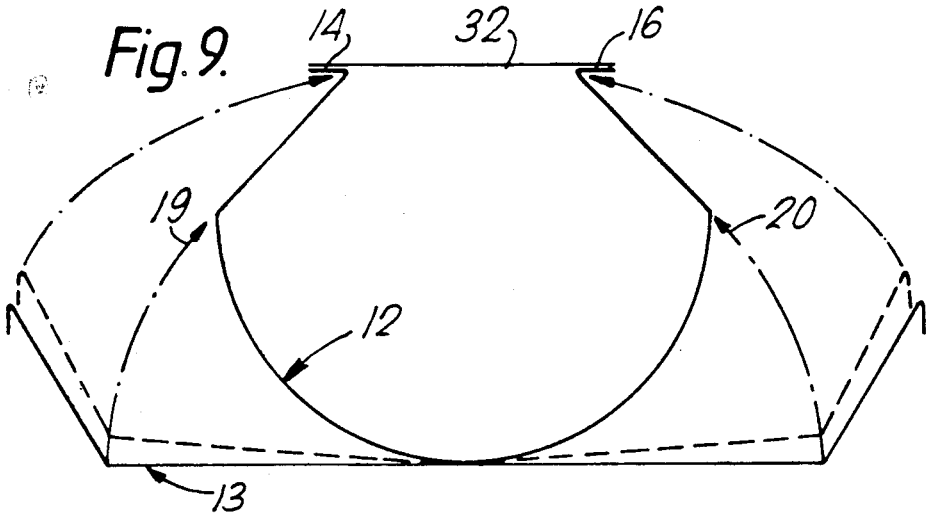
FIG. 9 illustrates the assembling into the final shape of a further embodiment of ceiling panel according to the invention.
Figure 10:
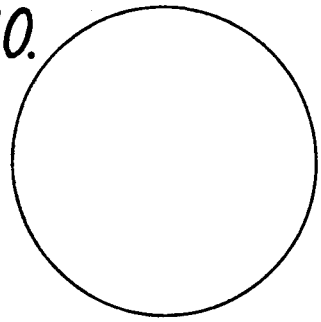
FIGS. 10-15 show six further constructions, with that of FIG. 14 being the result of the assembly indicated in FIG. 9.
Figure 11:
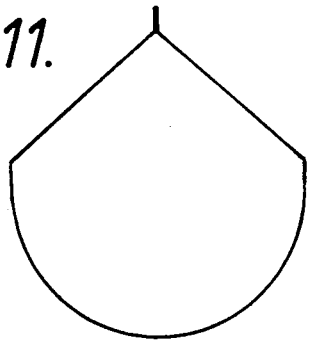
Figure 12:
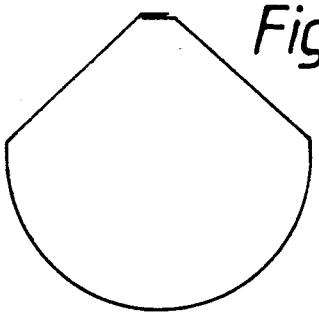
Figure 13:
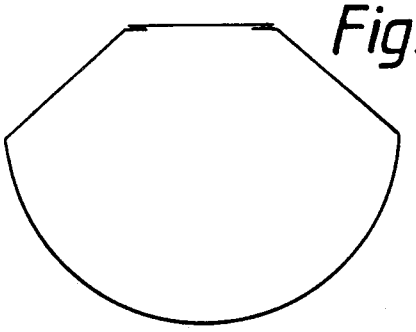

FIG. 9 illustrates a further form of panel according to the invention which, when assembled into its final shape, produces a rather more curved central visible portion 12. In this figure the central visible portion is shown in full line at 13 in its relaxed state and the arrows 19,21 show, via an intermediate stage shown in chain-dotted lines, how the panel is moved to its final deformed state within the elastic range of the material of the panel. It will be noted that the remainder of this structure is generally similar to FIG. 3 except for the shape of the intermediate portions and accordingly the same reference numerals have been used to denote similar parts.

Figure 15:
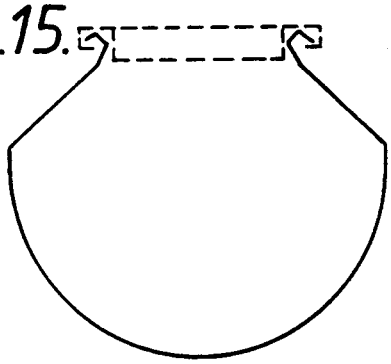

Instead of using an adhesively attached interconnecting structure as indicated at 32, it is also perfectly possible to use interconnecting clips not dissimilar to those illustrated in FIGS. 5 to 8. Such being further illustrated in FIG. 15.

Figure 14:
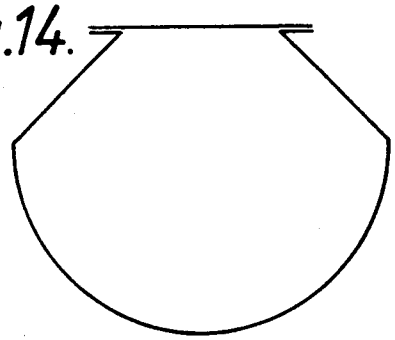

FIGS. 10-15 illustrate further configurations which can be achieved in the same way and detailed discussion of these is not thought necessary. It will be seen that the structure shown in FIG. 14 is that achieved using the mounting formation steps illustrated schematically in FIG. 9.

FIG. 16 illustrates a further construction in which the central visible portion 12 is formed from a plurality of spaced flat or slightly concave facets 50 to produce a generally downwardly bowed configuration for the visible portion 12 Each facet 50 is connected to its neighbour by a curved connection portion 51 permanently formed in the slat material and having a radius of curvature preferably less than 2 mm. FIG. 17 schematically illustrates two rolls 52 and 54 as having concave and convex axially spaced portions 56,58 respectively. The radius of curvature R of these portions is greater than the radius by which 0.2% yield of the material is produced and a radius of curvature r of the peaks 60 between the portions 56 of roll 52 is less than this 0.2% yield radius thereby providing the necessary permanent deformation. The flat sheet 64 is shown above the roll 52, 54 in FIG. 17, that is the sheet before it is fed between the rolls The resulting product, after being fed between the rolls 52,54 automatically adopts the bowed shape which is illustrated as 66 at the bottom of FIG. 17.

The panel obtained in this manner can be installed in a ceiling as shown in FIG. 16 by significant further curvature of the visible portion from its already slightly curved relaxed shape by mounting the inwardly flexed longitudinal side edges 14,16 resiliently between spaced adjacent ceiling panels.

By carrying out the deformation of the panels to the final shape so that the central visible portion has a shape which is significantly different from the relaxed original shape, adequate rigidity can be provided to the panels even if the material is relatively thin, for example if the sheet material has a thickness of less than 0.3 mm and even as little as 0.2 mm, that is to say material such as used in the manufacture of venetian blind slats. Thus, one can achieve very satisfactory results with much less expenditure on the materials than has hitherto been possible.

If reference is now made to FIG. 18, there will be seen therein a further structure of panel assembly which includes a carrier 126 having side flanges 127 formed with panel holding lugs 127*a* and a series of spaced apertures 127*b*, the spacing being to a given pitch The panel 110 is generally similar to that illustrated in FIG. 1 and has a central visible portion 112, longitudinal edge portion 114,116 connected to central visible portion by intermediate portions 118,120. The clips 134 are generally similar to the clips 34 of FIG. 6, with downturned end portions 142 retaining the panel in its final shape. In this structure, however, the side flanges 136 are formed with a second series of apertures 137, similar to the apertures 127*b* and of the same pitch.

FIG. 19 illustrates a slightly modified structure, like parts indicated by like reference numerals In this structure, however, instead of the lugs being formed as the lugs 127*c* of FIG. 18, they are formed on separate portions as 127*b*, and these engage under the edge portions 114,116, rather than under the portions 118,120 as in the FIG. 18 construction. This construction is indicated by the two curved arrows in FIG. 19.

It is contemplated that pins could be used to pass through the first set of apertures 127*b* and the second set of apertures 137 more firmly to secure the clips to the carriers. However, the primary use of these apertures is illustrated in FIGS. 20 and 21. It will often be the situation that the width of the panels will not exactly conform to the width of the room with which the panelling is to be used and it will be necessary to have only a portion of a panel immediately adjacent a wall. Such an arrangement is illustrated in FIGS. 20 and 21 and it will be seen that the visible portion 112 of the panel has been shown cut away to provide a free edge 113.

The arrangement in FIGS. 20 and 21 is similar to that shown in FIG. 18 and the clip 134 is cut off to a suitable length and is engaged over the edge 114 of the panel in a manner similar to that illustrated earlier with reference to FIGS. 6, 7 and 8.

In this structure, however, pins, for example split pins, indicated by the reference numerals 135 are passed through the apertures 137,127*b* firmly to retain the clip 134 in place, despite the fact that it is not supported at its right-hand side.

In order to prevent the cut edge 113 of the visible portion 112 from dropping, a bracket 145 is secured to the wall 155 by screws 147. This serves to support the free edge 113.

If reference is now made to FIG. 22, a method is shown of securing two portions of panel material together. Again, the panel material is similar to that illustrated in FIG. 1, the two panel portions 210*a*,210*b* having a beaded edge 214*a*,216*a*. The beads 214*b*,216*b* of the panel parts 210*b* are cut away for a portion of the length. Because of the general flexibility of the panel material, being formed of relatively thin stock, it can flex very readily and the centre portions, that it to say the visible portions 212*b* and the intermediate portions 218*b*,220*b*, can flex inwardly panel 210*a*.

Because the beads 214*b*,216*b* have been cut away, the flexing is facilitated and the two panel portions can readily be inter-engaged to overlap as indicated in the lower part of FIG. 22. A clip, such as the clip 34 of FIG. 6 or the clip 134 of FIG. 18, may be provided to retain the overlapped panel portions together A modified structure is illustrated in FIG. 23. Here the edge parts 314*a*,316*a* and 314*b*,316*b* are flat and can overlie one another. The central portions, that is to say the visible portions 312*a*,312*b* are sufficiently resilient and flexible to enable them readily to be flexed and telescoped so that the two panel parts inter-engage and overlap.

Use of such a structure may be made, by way of example, in a manner illustrated in FIG. 24. Here the panels, which may be panels similar to those of the invention, or conventional panels of a rather thicker material, are indicated by the reference numerals 410. Decorative flexible portions, for example similar to those illustrated in FIG. 23, which may, for example, be of a different colour, are flexed into place and are indicated by the general reference numeral 412. The actual configuration of these decorative portions 412 can be of any shape as desired to conform to the shape of the panels 410 which are being used. The length and the distributions and the shapes of the ends of the decorative portions 412 can be adapted in a number of different ways, some of which are illustrated in FIG. 24, to give a particular visual effect.

FIGS. 25*a*-29*a* show five further forms of roll which are shown as modifications of the forming rolls of FIG. 17. In each instance the appropriate forming rolls have, on at least one forming roll, a portion for forming a transverse bend of a given radius of curvature R disposed between adjacent forming portions on the other forming roll for forming transverse bends of a smaller radius of curvature R'. The magnitude of these radii of curvature is illustrated in terms of the thickness 't' of the sheet material. In FIG. 24*a* the larger radius of curvature R equals 3t while R' equals 1.5t. The resulting shape of the faceted panel is illustrated in FIG. 25*b*.

Figure 25A:
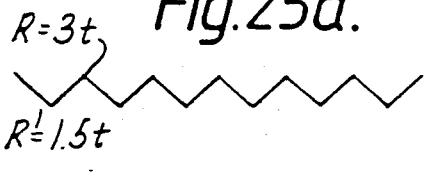
Figure 25B:
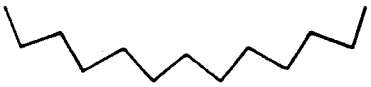
Figure 26A:
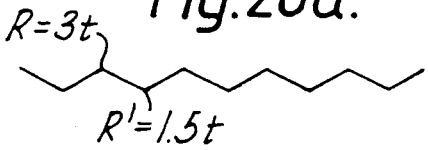
Figure 26B:
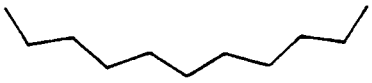

In FIG. 26*a* the radii of curvature are the same as in FIG. 25*a* but the extent of the radiused portion is different, thereby giving a rather flatter disposition of the undulations on the forming roll. Again the structure resulting in the faceted panel is illustrated in FIG. 26*b*.

Figure 27A:
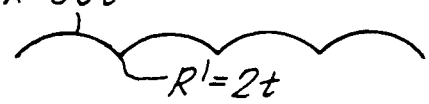
Figure 27B:
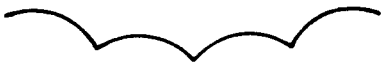

In FIG. 27*a* the radius of curvature R equals 50t and the radius R' equals 2t. The format of the resulting product is illustrated in FIG. 27*b*.

Figure 28A:
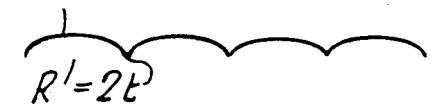
Figure 28B:
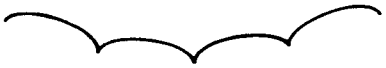

FIG. 28*a* has the same values for R and R', but the roll there illustrated is a barrel shaped roll, giving a slightly different resulting product shown in FIG. 28*b*.

Figure 29A:
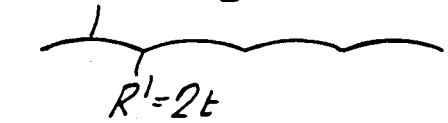
Figure 29B:
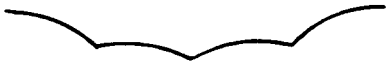

The structure illustrated in FIG. 29*a has R equal to* 100t and R' equal to 2t, giving the product illustrated in FIG. 29*b*.

It is contemplated that these faceted structures may be used in arrangements other than in ceilings and could, for example, be used as slats of a vertical louvre blind.

We claim:

1. A self-sustained cladding panel for use in a cladding system for a building, said panel being formed of a resilient metal or metal alloy sheet material having an elastic range of deformation and said panel comprising a generally central visible portion, longitudinally extending side edges, and means on said panel connecting said longitudinally extending side edges with respect to one another, said connecting means retaining said panel in a final shape under tension with the elastic range of deformation of said material with at least the central visible portion in an elastically deformed state.

2. A panel according to claim 1, wherein the central visible portion, in the final shape of the panel, is substantially flat, having been obtained from an appropriate negative bow in the relaxed state of the panel.

3. A panel according to claim 1, wherein, in the final shape of the panel, the central visible portion has an at least part circular bow having a radius of curvature in the region of at least 20 mm.

4. A panel according to claim 1, wherein the central portion is flat in its relaxed state and prior to interconnecting the longitudinal side edges.

5. A panel according to claim 1, wherein the central portion is curved in its relaxed state and prior to interconnecting the longitudinal side edges.

6. A panel according to claim 1, wherein the resilient metal or metal alloy has a high yield strength and a thickness of less than 0.3 mm.

7. A panel according to claim 1, wherein the longitudinal side edges each further comprises a rim portion, the rim portions each comprising at least one deformed edge connected to the remainder of the panel by a connecting portion with a radius of curvature of less than 2 mm.

8. A panel according to claim 1, wherein the longitudinal side edges are connected with respect to one another directly in abutting or closely adjacent relationship to form a virtually closed cross-sectional shape.

9. A panel according to claim 1, wherein the longitudinal side edges are connected with respect to one another indirectly and maintained at a distance from one another.

10. A panel according to claim 9, wherein the longitudinal side edges are interconnected at least over a part of their longitudinal extent by at least one additional strip like element.

11. A panel according to claim 9, wherein the longitudinal side edges are connected with respect to one another at spaced intervals along their length by a plurality of retaining clips.

12. A panel according to claim 6, wherein the central portion, in its relaxed state, is formed by a plurality of laterally adjacent longitudinally extending facets, each facet being connected to its neighbor by a curved connecting portion permanently formed in said material with a radius of curvature of less than 2 mm.

13. A panel according to claim 12, wherein the adjacent facets are each slightly concave, in the relaxed state, with respect to the convex connecting portions.

14. A cladding panel for use in a cladding panel system for a building, said cladding panel comprising a stiff grade, high yield strength, resilient, aluminium alloy sheet, longitudinally extending beads along each side of the panel, which have a radius of curvature sufficiently small to produce a permanent deformation of the sheet material, and a central visible portion of the panel bent to a radius of curvature which significantly exceeds the bend radius which would produce permanent deformation of the sheet material.

15. A panel according to claim 14, comprising a stiff grade, high yield strength, resilient, aluminium alloy sheet material of less than 0.3 mm thickness, said panel comprising a general central visible portion which, in use, is bowed with a radius of curvature greater than 20 mm and longitudinally extending side edges each formed with a bead having a radius curvature of less than 2 mm.

16. A panel according to claim 15, wherein the central visible portion is flat prior to mounting.

17. A panel according to claim 15, wherein the central visible portion is curved prior to mounting.

18. A cladding panel for use in a cladding system for a building said cladding panel comprises a stiff grade, high yield strength, resilient, aluminium alloy sheet, said panel comprising a generally central visible portion which is formed of a plurality of laterally adjacent facets, and which, in use, is bowed so that the junctions of the facets lie along a locus which has a radius of curvature which significantly exceeds the bend radius of the sheet material which would produce permanent deformation of the sheet material and longitudinally extending side edges each formed with a bead having a radius of curvature sufficiently small to produce a permanent deformation of the sheet material.

19. A panel according to claim 18, comprising a stiff grade, high yields strength, resilient, aluminium alloy sheet of less than 0.3 mm thickness, said panel comprising a generally central visible portion which is formed of a plurality of laterally adjacent facets, and which, in use, is bowed so that the junctions of adjacent facets lie along a locus which has a radius of curvature greater than 20 mm and longitudinally extending side edges each formed with a bead having a radius of curvature of less than 2 mm.

20. A panel according to claim 14, and further comprising intermediate portions, one on each side of said bowed central visible portion and extending therefrom to the beads on the longitudinal side edges.

21. A panel according to claim 20, wherein said intermediate portions are substantially flat.

22. A panel according to claim 20, wherein said beads are connected to said intermediate by further portions angled with respect to said intermediate portions and extending, in use, substantially parallel to one another.

23. A cladding system for a building comprising a plurality of panels, each panel being formed of a resilient metal or metal alloy sheet material having an elastic range of deformation and each panel having a generally central visible portion, longitudinally extending side edges, and means on said panel connecting said longitudinally extending side edges with respect to one another, said connecting means retaining said panel in a final shape under tension within the elastic range of deformation of said material with at least the central visible portion in an elastically deformed state, and supporting means mounted to hold said panels by engaging the longitudinal edges of said panels.

24. A cladding system according to claim 23, wherein the supporting means engage each of the panels internally of said longitudinal edges.

25. A cladding system according to claim 24, wherein said supporting means comprise spaced support members, and wherein the means connecting said longitudinal edges of each panel with respect to one another comprise retaining clips slidable longitudinally of the panels and wherein at least one of said retaining clips is co-operatively positioned adjacent the support members, effective to lock the panels in position with respect to said support means.

26. A cladding system according to claim 25, wherein said support member comprise elongate profiled carriers, the profiles of the carriers including a carrier body portion and at least one carrier flange portion, a free edge to the or each carrier flange portion, spaced sets of lugs associated with said free edge or edges for engagement with the side edges of the panels and, located adjacent each set of lugs, a first series of apertures in said at least one flange portion, the apertures of the series being spaced by a certain pitch, wherein the clips each include a clip body portion and a clip flange portion, said clip body portion having associated therewith means to retain the panel in its final shape, a second series of apertures formed in said clip flange portions, the apertures being spaced by said certain pitch and pin means engageable through selected ones of the apertures of the clips and the apertures of the carriers, effective to locate the clips relative to the carriers.

27. A cladding system according to claim 26, when used as a wall or ceiling cladding, wherein adjacent a perpendicular wall surface, a panel is longitudinally cut along a portion intermediate its cross-sectional width, its remaining longitudinally side edge being retained by one of said clip retaining means and one lug of a set and further comprising retaining means mounted on said perpendicular wall surface, said cut edge being engaged against said retaining means.

28. A cladding system according to claim 23, wherein said panels further comprise profiled longitudinal edge rims, wherein at least some panels of the system have end portions of the longitudinal edge rims removed and wherein the central visible portions associated with the removed rims are telescopically engaged within the ends of the longitudinally adjacent panels.

29. A cladding system according to claim 23, wherein end parts of the centrally visible portions of at least some of the panels are slightly deformed and telescopically engaged in the ends of longitudinally adjacent panels.

30. A cladding system according to claim 23, and further comprising additional short lengths of panel material are engaged over the panels at longitudinally spaced locations to give a patterned visual effect.

31. A cladding system comprising a plurality of panels, said panels each having a generally central visible portion which, in use, is formed into a bowed configuration and maintained under tension within the elastic range of deformation of said material and longitudinal side edges, wherein additional short lengths of panel material are engaged over the panels at longitudinally spaced locations to give a patterned visual effect.

32. A cladding system according to claim 31, wherein said additional short lengths of panel material are formed of a different colour from the remaining panel material.

* * * * *

US005115611A

REEXAMINATION CERTIFICATE (2299th)

United States Patent [19]

Lim et al.

[11] B1 5,115,611

[45] Certificate Issued May 10, 1994

[54] METAL CLADDING SYSTEMS

[75] Inventors: Guy H. Lim, Rotterdam; Willem Rijnders, Papendrecht; Cornelis Louwerens, Rotterdam, all of Netherlands

[73] Assignee: Hunter Douglas International, Curacao, Netherlands Antilles

Reexamination Request:
No. 90/003,148, Aug. 2, 1993

Reexamination Certificate for:

| | |
|---|---|
| Patent No.: | 5,115,611 |
| Issued: | May 26, 1992 |
| Appl. No.: | 570,262 |
| Filed: | Aug. 20, 1990 |

[30] Foreign Application Priority Data

| | | | |
|---|---|---|---|
| Aug. 25, 1989 | [GB] | United Kingdom | 8919330 |
| Jun. 22, 1990 | [GB] | United Kingdom | 9014274 |

[51] Int. Cl.[5] ..... E04B 2/00

[52] U.S. Cl. ..... 52/537; 52/222; 52/484; 52/763; 52/762; D25/122

[58] Field of Search ..... 52/762, 763, 764, 484, 52/488, 222, 537

[56] References Cited

FOREIGN PATENT DOCUMENTS

| | | |
|---|---|---|
| 0443968 | 5/1971 | Australia . |
| 1955780 | 6/1971 | Fed. Rep. of Germany . |
| 2353231 | 5/1975 | Fed. Rep. of Germany . |
| 3017103 | 11/1981 | Fed. Rep. of Germany . |
| 1361989 | 4/1964 | France . |
| 2081712 | 10/1971 | France . |
| 0069411 | 5/1974 | Luxembourg . |
| 0415146 | 8/1934 | United Kingdom . |
| 0986887 | 3/1965 | United Kingdom . |
| 1393346 | 5/1975 | United Kingdom . |
| 2021186 | 11/1979 | United Kingdom . |
| 2164972 | 4/1986 | United Kingdom . |

*Primary Examiner*—Carl D. Friedman

[57] ABSTRACT

The specification discloses a method of forming a self sustained cladding panel 10 for use in a cladding panel system for a building using a resilient material or metal alloy sheet material. The panels have a central visible portions 12 and longitudinally extending side edges 14, 16. The central visible portion has, in its relaxed state, a shape which is significantly different from the intended final shape and the panel is subsequently formed so that its central visible portion is resiliently formed into the final shape, with a resilient deformation taking place within the elastic range of the sheet material. The panel is then retained in this final shape by interconnecting the longitudinally extending side edges 14, 16 either continuously or by spaced elements such as clips.

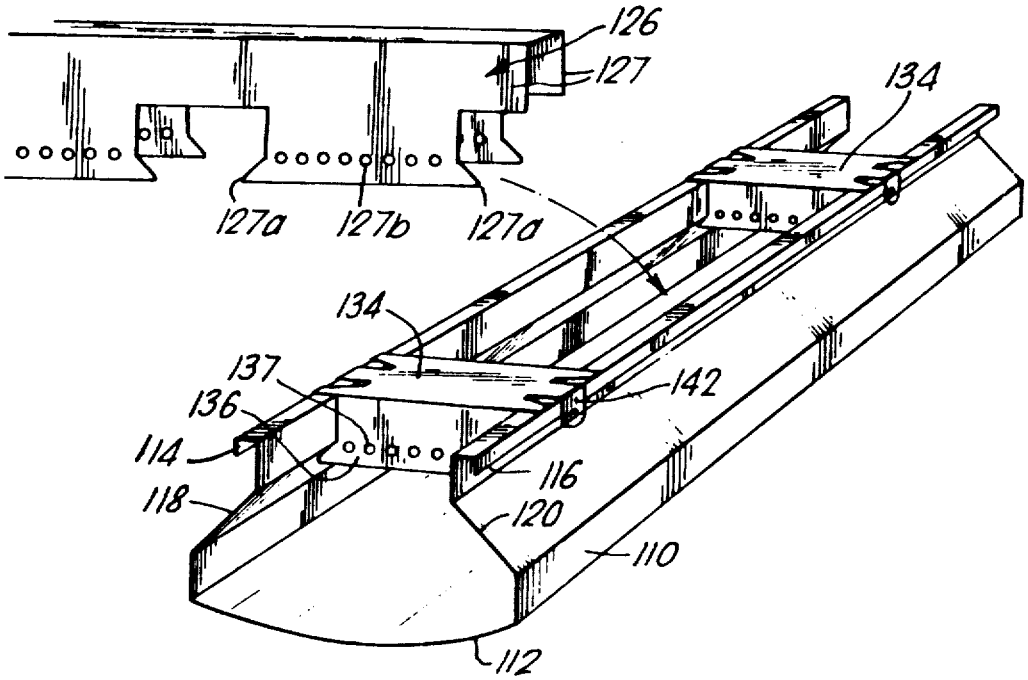

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

The drawing figures have been changed as follows: Reference numeral 51 has been added to FIG. 16; Reference numeral 114 has been substituted for numeral 145 in FIG. 18; Reference numeral 127c has been substituted for numeral 127b in FIG. 19; Reference numeral 316a has been substituted for 316b in FIG. 23; new FIG. 4A has been added.

AS A RESULT OF REEXAMINATION, IT HAS BEEN DETERMINED THAT:

The patentability of claims 26 and 27 is confirmed.

Claims 1-13, 18-25 and 28-32 are cancelled.

Claim 14 is determined to be patentable as amended.

Claims 15-17 dependent on an amended claim, are determined to be patentable.

14. A cladding panel for use in a cladding [panel] system for a building, said cladding panel [comprising] *being formed of* a stiff grade, high yield strength, resilient, aluminum alloy [sheet,] *and comprising* [longitudinally extending beads along each side of the panel, which have a radius of curvature sufficiently small to produce a permanent deformation of the sheet material, and] a central visible portion [of the panel] bent to a radius of curvature which *when said panel is installed in the cladding system* significantly exceeds the bend radius which would produce permanent deformation of the [sheet material.] *panel, a pair of first intermediate portions on opposing sides of said central visible portion, a pair of second intermediate portions, one on each said first intermediate portion opposite said central visible portion and angled with respect to said first portion, and a longitudinally extending bead along each said second intermediate portion opposite said first portion, whereby when said panel is installed in the cladding system, said first intermediate portions are substantially parallel to one another.*

* * * * *